US009328586B2

(12) United States Patent
Kanstad et al.

(10) Patent No.: US 9,328,586 B2
(45) Date of Patent: May 3, 2016

(54) HEAT TRANSPORT DEAD LEG

(75) Inventors: Stig Kàre Kanstad, Fana (NO); Erik Nilsen, Loddefjord (NO)

(73) Assignee: FRAMO ENGINEERING AS, Bergen (NO)

( * ) Notice: Subject to any disclaimer, the term of this patent is extended or adjusted under 35 U.S.C. 154(b) by 0 days.

(21) Appl. No.: 13/320,990

(22) PCT Filed: May 25, 2010

(86) PCT No.: PCT/NO2010/000187

§ 371 (c)(1), (2), (4) Date: Mar. 5, 2012

(87) PCT Pub. No.: WO2010/137989

PCT Pub. Date: Dec. 2, 2010

(65) Prior Publication Data

US 2012/0152558 A1 Jun. 21, 2012

(30) Foreign Application Priority Data

May 26, 2009 (NO) ..... 20092032

(51) Int. Cl.
*E21B 36/00* (2006.01)
*E21B 37/06* (2006.01)
(Continued)

(52) U.S. Cl.
CPC ..... *E21B 36/00* (2013.01); *E21B 37/06* (2013.01); *E21B 43/12* (2013.01); *E21B 43/24* (2013.01)

(58) Field of Classification Search
CPC ..... E21B 43/24; E21B 36/00; E21B 36/001; E21B 36/008; E21B 36/003; E21B 36/005; E21B 36/006; F24J 2/24; F24J 3/08; H05B 2214/03; H05B 2203/021; Y02E 10/10; F16L 59/00; F16L 53/001
USPC ..... 166/344, 345, 302, 57
See application file for complete search history.

(56) References Cited

U.S. PATENT DOCUMENTS 56,989 A * 8/1866 Phleger ..... E21B 36/04 166/302
193,838 A * 8/1877 West ..... E21B 36/04 122/485

(Continued)

FOREIGN PATENT DOCUMENTS

GB 2 453 125 A 4/2009

OTHER PUBLICATIONS

Andersen, H. "Computational study of heat transfer in subsea deadlegs for evaluation of possible hydrate formation", Thesis, Institut Für Fernmeldetechnie, Technische Universitat Berlin, Jun. 1, 2007.

(Continued)

*Primary Examiner* — Matthew R Buck
*Assistant Examiner* — Edwin Toledo-Duran
(74) *Attorney, Agent, or Firm* — Merchant & Gould P.C.

(57) ABSTRACT

The invention concerns a subsea system transporting fluid, wherein the subsea system comprises a first part having a flow path carrying a flow of fluid and at least a second part having a flow path provided for carrying fluid. The second part is temporarily being closed off from the flow path of the first part of the subsea system. The heat from the fluid transported in the first part of the subsea system is transferred to the second part by a heat conducting structure establishing a contact between the first and second part of the subsea system, to prevent the formation of hydrates in the second part of the subsea system.

12 Claims, 3 Drawing Sheets

(51) Int. Cl.
*E21B 43/12* (2006.01)
*E21B 43/24* (2006.01)

(56) References Cited

U.S. PATENT DOCUMENTS 239,975 A * 4/1881 Shoune ..... E21B 36/04 166/302
59,782 A * 11/1886 Murray ..... E21B 36/04 122/485
1,489,444 A * 4/1924 Kestler ..... E03B 7/12 138/33
1,587,838 A * 6/1926 Houk ..... E21B 35/00 166/57
1,716,854 A * 6/1929 Husted ..... E21B 36/00 166/57
1,960,866 A * 5/1934 Chadwick ..... F16L 53/002 137/340
2,914,124 A * 11/1959 Ripley, Jr. ..... E21B 36/006 165/45
3,195,634 A * 7/1965 Hill ..... E21B 37/00 166/302
3,322,195 A * 5/1967 Brown ..... C01B 3/40 166/300
3,357,407 A * 12/1967 Fanaritis ..... E21B 43/24 122/1 R
3,785,402 A * 1/1974 Collier ..... F16L 57/00 137/561 A
3,825,122 A * 7/1974 Taylor ..... B01D 61/06 210/134
4,565,243 A * 1/1986 Ernst et al. ..... 165/104.26
4,679,598 A * 7/1987 Jee ..... E21B 43/01 138/103
4,993,483 A * 2/1991 Harris ..... F24J 3/083 165/104.11
5,265,677 A * 11/1993 Schultz ..... E21B 47/011 166/302
5,590,715 A * 1/1997 Amerman ..... E21B 23/00 165/45
5,803,161 A * 9/1998 Wahle ..... F28D 15/0233 165/104.21
5,884,706 A * 3/1999 Edwards ..... E21B 33/12 166/335
6,000,438 A * 12/1999 Ohrn ..... E21B 17/01 138/149
6,062,308 A 5/2000 Flood
6,253,855 B1 * 7/2001 Johal ..... E21B 17/01 166/345
6,267,172 B1 * 7/2001 McClung, III ..... E21B 17/01 126/612
6,338,381 B1 * 1/2002 McClung, III ..... E21B 17/01 165/45
6,415,868 B1 * 7/2002 Janoff ..... E21B 36/003 138/149
6,419,018 B1 7/2002 Naquin et al.
6,460,568 B1 * 10/2002 Goodwin ..... B67D 1/08 137/561 A
6,585,047 B2 * 7/2003 McClung, III ..... E21B 17/01 166/302
6,684,948 B1 * 2/2004 Savage ..... E21B 41/0085 166/248
6,939,082 B1 * 9/2005 Baugh ..... B08B 7/0071 138/32
7,581,593 B2 * 9/2009 Pankratz ..... E21B 36/04 166/265
2005/0028974 A1 * 2/2005 Moody ..... E21B 49/081 166/264
2005/0061512 A1 * 3/2005 Reid ..... E21B 36/005 166/335
2007/0107901 A1 * 5/2007 Maguire ..... E21B 43/247 166/302
2007/0284108 A1 * 12/2007 Roes ..... E21B 36/04 166/302
2009/0205833 A1 * 8/2009 Bunnell ..... E21B 23/00 166/373
2012/0132434 A1 * 5/2012 Yemington ..... B63B 27/24 166/345
2013/0186498 A1 * 7/2013 Dugan ..... F16L 53/001 138/32
2015/0075753 A1 * 3/2015 Uno ..... F24H 1/12 165/104.21

OTHER PUBLICATIONS

International Search Report for corresponding International Patent Application No. PCT/NO2010/000187 mailed Dec. 3, 2010.
Norwegian Search Report for corresponding Norwegian Patent Application No. 20092032 mailed Dec. 21, 2009.
International Preliminary Report on Patentability for corresponding International Patent Application No. PCT/NO2010/000187.

* cited by examiner

FIG. 1
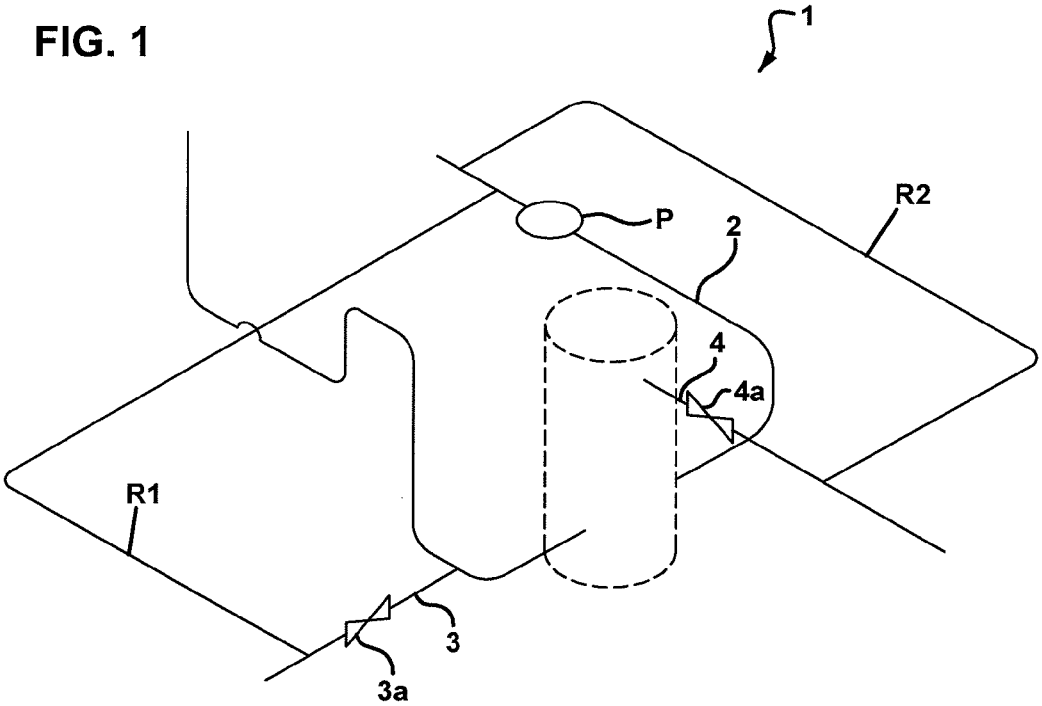
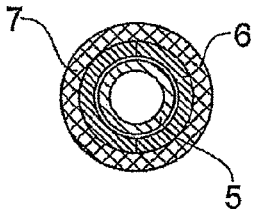
FIG. 2
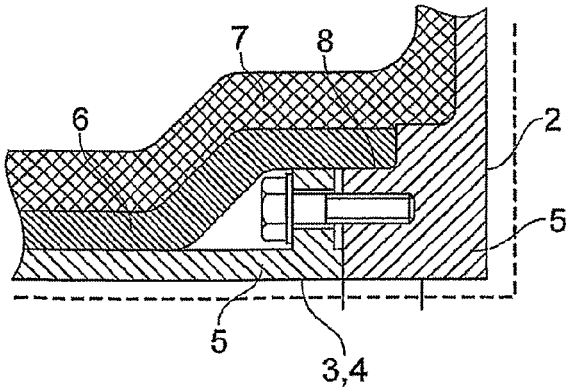
FIG. 3

HEAT TRANSPORT DEAD LEG

This application is a National Stage Application of PCT/NO2010/00187, filed 25 May 2010, which claims benefit of Ser. No. 20092032, filed 26 May 2009 in Norway and which applications are incorporated herein by reference. To the extent appropriate, a claim of priority is made to each of the above disclosed applications.

The invention concerns a subsea system for transport of fluid in accordance with the preamble of claim 1.

In subsea systems such as production systems problems may occur when parts of the system where fluid normally flows are closed off or isolated from the rest of the system. The closed off parts of the system are often referred to as a "dead leg". The "dead leg" may be constituted by any component of a subsea system, but may often be a pipe component. All dead legs are potentially problem areas in the system as they may be blocked by amongst other hydrates and hence not be available when needed, a situation which may lead to loss of functionality, time and money, and potentially provide a dangerous situation to people and the environment.

A pipe element between a main process and an isolation valve may experience the problems associated with the dead leg. The same also applies to a line of recirculation connecting the outlet of the pump to the suction of the pump, ensuring that the pump is operating above a minimum flow limit. For long periods such a line may be closed down.

Dead legs may be isolated from the process and bleeded, but usually only a valve is provided to prevent fluid from entering the closed off parts of the system. Parts of the fluid, for instance process fluid, may be flowing past the dead leg. If the dead leg is closed off for a long period of time, it may occur that some of the hot process fluid enters the dead leg, wherein the fluid is cooled down and over time hydrates and/or wax may be formed and block the line. Fluid trapped in the dead leg may also form wax and hydrates. Generally dead legs may be formed when any sort of blockage of the fluid path of the system occurs, such as for instance the presence of a blind flange.

Based on the problems with the formation of hydrates as explained above, a need for protecting the subsea system against the formation of hydrates has evoked. In accordance with prior art solutions, insulation has been provided around the potential dead leg to prevent hydrates from forming. Further, in accordance with prior art solutions, the dead leg has been heated (by means of an active external heat sources) and the volume of the dead leg has been isolated and depressurized or inhibited. Or the length of the dead leg is kept as short as possible.

It is an object of the invention to provide a solution solving the problems of the dead leg by preventing the formation of hydrates, wax, etc. The solution is provided in accordance with the invention as defined in claim 1. Further embodiments of the invention are defined in the proceeding claims.

The principle of the invention is to maintain the temperature in a dead leg above a critical temperature when the subsea system is in normal operation. The proposed solution is passive, with no need for any regulation and is based on energy available from the process.

In accordance with the independent claim the invention concerns a subsea system for transport of fluid. The subsea system comprises a first part having a flow path carrying a flow of fluid and at least a second part having a flow path provided for carrying fluid. The flow path of the second part is temporarily being closed off from the flow path of the first portion. To prevent the formation of hydrates in the second part of the subsea system, heat or energy from the fluid transported in first part of the subsea system is transferred to the second part by a heat conducting structure establishing a contact between the first and second part of the subsea system. The fluid flowing in the first part of the subsea system may be any fluid transported in a subsea system. The second part may be closed off from the first part of the sub sea system in various ways as described above.

In accordance with a first embodiment of the invention, the heat conducting structure extends along the flow path of at least a portion of the first and second part of the subsea system. By this arrangement contact is established between the two parts of the subsea system and heat is transferred following the flow path from the part of the subsea system wherein fluid is flowing to the closed second part of the system wherein there is a risk for forming hydrates. The first and the second part of the subsea system may be arranged in line sequentially. The heat transfer may then occur in an axial direction. The two parts, for instance when being made up by pipe elements may be arranged in an angled relationship, wherein the heat transfer occurs in an axial direction along portions of the second part. A contact area is established between the heat conducting structure and the first part. The contact area may have an axial extension which may be limited to a portion of the axial extension of the first part or corresponding to the axial extension of first part. When the second part, the potentially dead leg is a pipe element, the increase in axial conduction along the pipe element is of special effect for preventing formation of hydrates, and then the arrangement of a portion of the heat transfer structure extending axially along this pipe element contributes considerably to keeping the temperature within the pipe element (dead leg) above the hydrate formation temperature.

In the accordance with one aspect of the invention at least one of the first and/or second part of the subsea system comprises at least one pipe element. Plural pipe elements may be connected to make pipeline or a pipe, alternatively the one pipe element may define a pipe. In one aspect the portion of the heat conducting structure in contact with the second part of the subsea system may have an axial extension corresponding essentially to the axial extension of the second part of the subsea system to achieve a satisfactory axial conduction in the second part of the part of the subsea system. The contact between the heat conducting structure and the first part of the subsea system may have an axial extension along the axial extension of the first part of the subsea system, or may be limited to a smaller contact area.

In the case where the first part of the subsea system comprises a pipeline and the second part of the subsea system also comprises a pipe, the heat conducting structure may follow at least a portion of the length/axial direction of the pipeline and the pipe. The heat conducting structure may then have an axial extension corresponding at least to a portion of the axial extension of the pipeline/pipe. Alternatively the heat conducting structure may follow the pipe (the second part) axially, while the limited contact area is established with the pipeline (the first part). The portion of the heat conducting structure in contact with the pipe may have an axial extension corresponding to the pipe. By increasing the axial heat transport alongside the pipe, the temperature drop along the dead leg will be reduced. Consequently a higher temperature is maintained in the dead leg.

The heat conducting structure will be made of a material having a satisfactory coefficient of conductivity. A sufficient increase in the axial conduction or heat transport and reduction in heat losses may hence bring the minimum temperature in the dead leg above a predetermined critical value.

In a second embodiment of the invention the first and second part of the subsea system are arranged in an essentially parallel relationship. The heat conducting structure is provided in between the first and second part of the subsea system at least along a portion of the length of the first and second part of the subsea system.

In a third embodiment the first and second part of the subsea system are arranged in an essentially parallel relationship and the heat conducting structure comprises plural heat conducting elements connecting first and second part of the subsea system in an essentially lateral arrangement.

As mentioned above at least one of the first and second part of the subsea system comprises at least one pipe element providing a flow path for the fluid. The heat conducting structure may be arranged surrounding the pipe element and may be arranged in contact with the pipe element. Further the heat conducting structure may have an axial extension corresponding at least to a portion of the axial extension of the first and second part of the subsea system and/or a circumferential extension corresponding at least to a portion of circumferential extension of the first and second part of the subsea system. In one aspect the heat conducting structure makes up an outer pipe element surrounding the pipe element.

The heat conducting structure may be applied to the inner pipe element to make a sandwich construction to increase the conductivity. This could be done by for instance with a HIP (Hot Isostatic Pressure) or a sinter process for providing a good conducting material on the surface of the pipe wall. The high conducting material can, if required due to corrosion be "baked" between two materials hence being fully enclosed by the pipe material. Actual materials could be for instance aluminium (ca 200W/mK), copper (ca 400W/mK) or various high conducting alloys. Effective conduction coefficients for the composite of 300 W/mK or higher should be achievable.

Other alternatives could be to use two sections (upper half and lower half) of conducting material and clamp it around the pipe. Heat pipes could be used to transport the energy or circulate fluid by self circulation using gravity and self circulation.

As mentioned above, in one aspect of the invention the first part of the subsea system may comprise a pipe line and the second part of the subsea system a pipeline comprises a pipe. The heat conducting structure may then be arranged surrounding at least a portion of the pipeline and the pipe. Alternatively the heat conducting structure makes up the pipe line and the pipe, and then the one and same element both fulfils the function of transporting the fluid and transferring the heat from the first to the second part of the subsea system. Alternatively, the heat conducting structure may be arranged inside the pipeline and the pipe connecting at least a portion of the pipeline and the pipe for the transfer of heat between the two parts of the subsea system. The heat conducting structure may for instance be positioned coaxially with the pipe/pipe line. As the skilled person will realize the third embodiment of the invention may be combined with one or more of the following arrangements; the arrangement of positioning the heat conducting structure inside the pipe/pipeline, providing the heat conducting structure so that it makes up the pipe line/pipe and arranging the heat conducting structure surrounding the pipe/pipeline.

At least a portion of the subsea system may be arranged with an outer insulation structure. The system of insulation will be carried out in accordance with the various embodiments. The insulation could be traditional insulation materials or using vacuum (thermos) etc.

In one aspect the subsea system comprises a system for production of hydrocarbons and the flow of fluid comprises a process fluid.

In another aspect the subsea system may comprise a fluid line and a valve device which is provided to close the second part of the subsea system off from the first part of the subsea system.

In another aspect of use the subsea system comprises a fluid line including a pump wherein the second part of the subsea system comprises a line of recirculation the fluid to the inlet of the pump.

An example of the invention is to be described in the following with reference to the figures wherein:

FIG. 1 shows an example of a layout of a subsea pipe system.

FIG. 2 shows first embodiment of the invention.

FIG. 3 shows an example of a first embodiment of the invention.

Figure 4:
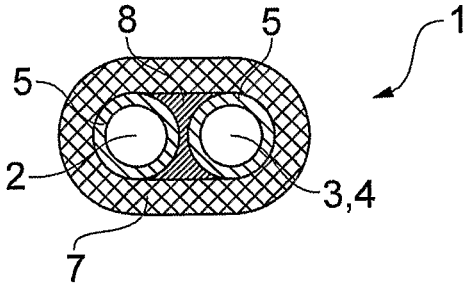
FIG. 4 shows a second embodiment of the invention.

FIG. 1 shows an example of a layout of a subsea pipe system 1 providing a flow path for carrying fluid. The subsea pipe system 1 comprises a first part, in this example shown as pipe line 2, and a second part, such as pipes 3, 4 branching off from the pipe line 2. These branches are provided with means such as valves 3*a* , 4*b* for temporarily closing off fluid flow through the pipes 3, 4. When no fluid is flowing through the pipes 3, 4, there is a risk for the formation of hydrates in this part of the subsea system. The pipes 3, 4 being closed off from fluid flow are defined as dead legs. The pipe line 2 includes a pump P and the subsea pipe system 1 includes a line of recirculation R1 and R2 to the inlet of the pump P.

To avoid the formation of hydrates the subsea pipe system 1 is provided so that heat is transferred from the pipeline 2 to the pipes 3, 4 being closed off. This transfer of heat is carried out by a heat conducting structure establishing contact between the pipeline 2 and the pipes 3, 4.

In FIG. 2 an example of a first embodiment of the invention is shown. In accordance with this embodiment the cross section of the pipeline 2 and pipes 3, 4 are similar and correspond to the cross section as shown in FIG. 2. The pipeline 2 and pipes 3, 4 comprise an inner pipe element 5 for instance a steel pipe having a flow path for the carrying of the fluid. An outer pipe element 6 made of a material having comparatively better conducting features than the inner pipe element 5 surrounds the inner pipe element 5, and makes up the heat conducting structure. The outer pipe element 6 has an extension along the inner pipe element 5 and extends from the pipeline 2 to the pipes 3, 4 in a direction following the flow path making sure that heat accumulated from the fluid transported in the pipeline 2 is transferred to the pipes 3, 4 to prevent the formation of hydrates. In order to further reduce the loss of heat to the surroundings, the subsea system 1 may possibly be arranged with an outer insulation structure 7.

FIG. 3 shows an example of the first embodiment of the invention. A part of the pipeline 2, wherein an inner pipe element carries a fluid flow, is surrounded by the outer pipe element 6 for transferring the heat from the pipeline 2 to the pipe branches 3, 4. The outer pipe element 6 extends along the inner pipe element of pipe branches 3, 4 transferring the heat from the pipeline 2 to the pipe branches 3, 4 in a direction following the fluid path. A heat bridge 8 shows the transfer area of heat from the pipeline 2 to the branches 3, 4 by means of the heat conducting structure constituting the outer pipe element 6. The outer insulation structure 7 is also shown in FIG. 3.

FIG. 4 shows a cross section of a second embodiment of the invention wherein the pipeline 2 carrying fluid is arranged in a parallel relationship with the pipe 3, 4. The heat is to be transferred from the pipeline to the pipes in order to avoid the formation of hydrates. The arrangement of the pipeline 2 and pipe 3, 4 are surrounded with an embodiment of the insulation structure 7 covering both the pipeline 2 and the pipe 3, 4. The heat conducting structure is provided by the heat conducting element 8 filling in the gap between the pipeline 2 and the pipe 3, 4 ensuring a satisfactory transfer of heat between the pipeline and the possible dead leg pipe 3, 4.

Figure 5:
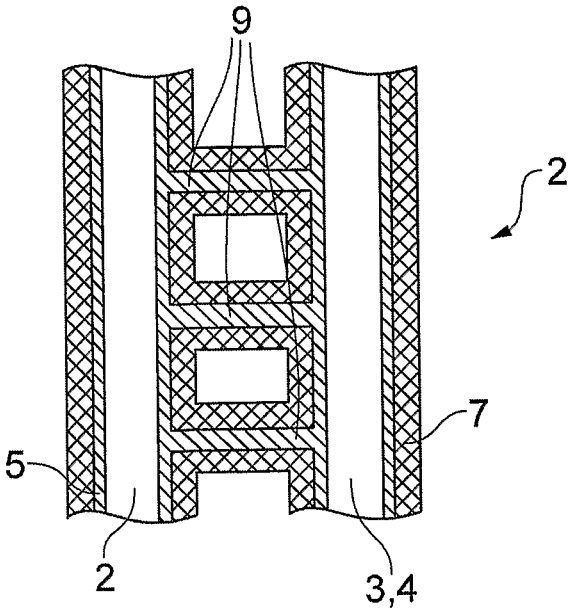
FIG. 5 shows a third embodiment of the invention.

FIG. 5 shows a cross section of a third embodiment of the invention. Pipeline 2 and the pipe 3, 4 are also here arranged in a parallel relationship. The heat conducting structure is provided by the heat conducting rods 9 being laterally oriented between the parallel pipes and pipeline making sure that the heat is transferred along the axial extension of the pipe. The subsea system is provided with the insulation structure 7.

Figure 6:
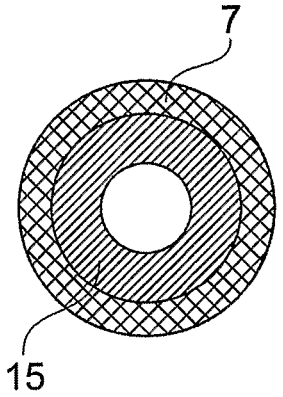
FIG. 6 shows a fourth embodiment of the invention.

FIG. 6 shows a cross section of a fourth embodiment of the invention wherein a pipe element 15 itself has high thermal conducting features and thereby is designed to constitute the heat conducting structure. The axial conduction of heat between the first and second part of the subsea system will thereby be carried out by the pipe element 15 and there is no need for an additional heat conducting structure. An insulation structure 7 surrounds the pipe element.

In some cases the invention may be provided so that the heat conducting structure is constituted by the combination of the pipe element 15 and an additional heat conducting element arranged inside or outside the pipe element, wherein the thermal conducting features of these two element are selected to arrange for the total heat transfer necessary to avoid the formation of hydrates in the second part of the subsea system.

Figure 7:
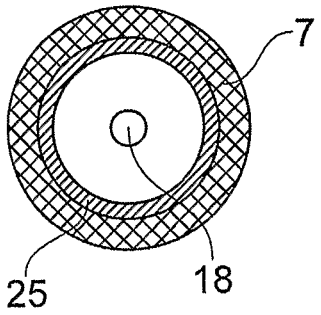
FIG. 7 shows a fifth embodiment of the invention.

FIG. 7 shows a cross section of the fifth embodiment of the invention wherein the heat conducting structure is constituted by a heat conducting element 18 arranged inside the pipe element 25. The heat conducting element 18 may be formed as rod or tubular shaped element or any other element preferably elongated, having an extension in the direction of the fluid path of the subsea system and capable of providing a connection between the first and second part of the subsea system.

The invention claimed is:

1. A subsea system for transporting a fluid, wherein the subsea system comprises a first part having a flow path carrying a flow of the fluid and at least a second part having a flow path provided for carrying the fluid, which second part is temporarily closed off from the flow path of the first part of the subsea system, wherein heat generated by the motion of the fluid transported in the first part of the subsea system is transferred to the second part by a heat conducting structure establishing a contact between the first part and the second part of the subsea system to prevent the formation of hydrates in the second part of the subsea system and wherein the motion of the fluid in the first part is provided by a pump, and the second part comprises a line for recirculation of the fluid to an inlet of the pump.

2. The subsea system in accordance with claim 1, wherein at least one of the first and second part of the subsea system comprises at least one pipe element.

3. The subsea system in accordance claim 1, wherein the heat conducting structure extends along the flow path of at least a portion of the first and second part of the subsea system.

4. The subsea system in accordance with claim 2, wherein the heat conducting structure is arranged surrounding the at least one pipe element.

5. The subsea system in accordance with claim 2, wherein the heat conducting structure makes up the at least one pipe element.

6. The subsea system in accordance with claim 2, wherein the heat conducting structure is arranged inside the at least one pipe element.

7. The subsea system in accordance with claim 1, wherein the first and second part of the subsea system are arranged in an essentially parallel relationship.

8. The A subsea system in accordance with claim 7, wherein the heat conducting structure comprises plural heat conducting elements connecting first and second part of the subsea system in an essentially lateral arrangement.

9. The A subsea system in accordance with claim 1, wherein the first part of the subsea system comprises a pipe line and the second part of the subsea system comprises a pipe.

10. The subsea system in accordance with claim 1, wherein at least a portion of the subsea system is arranged with an outer insulation structure.

11. The subsea system in accordance with claim 1, wherein the subsea system comprises a system for production of hydrocarbons and the flow of the fluid comprises a process fluid.

12. The subsea system in accordance with claim 1, wherein the subsea system comprises a valve device that is provided to close the second part of the subsea system off from the first part of the subsea system.

* * * * *